United States Patent [19]

Koike et al.

[11] Patent Number: 4,973,495

[45] Date of Patent: Nov. 27, 1990

[54] METHOD OF FORMING COLOR TUBE PHOSPHOR SCREEN

[75] Inventors: Norio Koike; Kazuhiko Shimizu, both of Fukaya; Ryoichi Ogura, Takasago, all of Japan

[73] Assignee: Kabushiki Kaisha Toshiba, Kawasaki, Japan

[21] Appl. No.: 299,199

[22] Filed: Jan. 19, 1989

[30] Foreign Application Priority Data

Jan. 20, 1988 [JP] Japan ..... 63-8262

[51] Int. Cl.[5] ..... H01J 29/22; B05D 1/36; B05D 7/22

[52] U.S. Cl. ..... 427/68; 427/71; 427/73

[58] Field of Search ..... 427/68, 71, 73

[56] References Cited

U.S. PATENT DOCUMENTS

| | | | |
|---|---|---|---|
| 3,440,080 | 4/1969 | Tamura et al. | 427/68 |
| 3,582,389 | 6/1971 | Squinier | 427/68 |
| 4,086,090 | 4/1978 | Kohaski et al. | 427/68 |
| 4,243,735 | 1/1981 | Kobale | 427/68 |
| 4,293,586 | 10/1981 | Unnai et al. | 427/68 |
| 4,717,856 | 1/1988 | Kato | 313/466 |

FOREIGN PATENT DOCUMENTS

| | | | |
|---|---|---|---|
| 0232528 | 10/1986 | Japan | 427/68 |
| 2100926 | 5/1987 | Japan | 427/68 |

*Primary Examiner*—Janyce Bell

*Attorney, Agent, or Firm*—Cushman, Darby & Cushman

[57] ABSTRACT

According to the present invention, there is provided a method for forming a color tube phosphor screen comprising the steps of forming a light-absorbing matrix having holes on a faceplate, coating a silica colloidal solution or an alumina colloidal solution containing a multivalent metal ion in said holes and washing said holes, and forming phosphor layers of three colors in said washed holes. The color tube phosphor screen formed through the method of the present invention has no phosphor residual, especially pigment residual.

3 Claims, 3 Drawing Sheets

METHOD OF FORMING COLOR TUBE PHOSPHOR SCREEN

BACKGROUND OF THE INVENTION

1. Field of the Invention

The present invention relates to a method of forming a color tube phosphor screen without a phosphor residual, especially a pigment residual.

2. Description of the Related Art

In order to form a phosphor screen of the color tube, after a photoresist is coated, exposed and developed thereby forming a predetermined pattern, a light absorber for increasing the contrast of a phosphor screen is coated thereon. Thereafter, holes are formed at predetermined portions where phosphor layers are subsequently formed, the layers being of three colors.

When the apertures for phosphor layer formation are to be formed, however, it is difficult to completely decompose and remove the photoresist pattern beneath the light absorber. Therefore, the photoresist of a thickness of about 100 Å often remains in the holes. For this reason, when a phosphor slurry of a first color is coated and dried in the holes and then exposed and developed to form a phosphor layer of a first color, phosphor particles of the first color adhere on the residual resist layer in holes for phosphor layers of second and third colors. When the phosphor layers of the second and third colors are formed, therefore, the phosphor particles of the two or more colors are mixed with each other to degrade the color purity.

In order to solve the above problem, Japanese Patent Disclosure (Kokai) No. 56-99945 discloses a method in which after a light-absorbing matrix is formed, a $Si_2O$ dispersion solution is coated on the entire inner surface of a faceplate and exposed to a HF atmosphere, thereby changing $Si_2O$ from a sol state to a gel state. This invention provides the treatment against a residual photoresist layer because it is difficult to completely remove the photoresist layer in the holes light-absorbing matrix before phosphor layers are formed. When, for example, PVA is used as a resin component of the photoresist, silica is coated on phosphor particles in order to improve the dispersity of the particles. When PVA and silica are brought into contact with each other, each of PVA and silica on the surfaces of phosphor particles are charged to be (+) and (−), respectively. Therefore, before the phosphor coated with silica is coated on the holes in which the resist layer remains, other silica particles in a gel state are supplied in the holes to adhere therein. Thereafter, the phosphor particles dispersed in the PVA solution are supplied on the faceplate. In this case, the surfaces of the phosphor particles and the surfaces of holes are charged to be (−), since both surfaces are coated with silica particles. Therefore, both surfaces electrically repulse each other. As a result, no phosphor particles remain on the faceplate.

Recently, in order to improve the contrast under ambient light, filters are provided to phosphor layers of the three colors. That is, the phosphor articles are emissive of light in a particular portion of the visible spectrum, and the filter is transmissive of light in those portions of the spectrum and absorptive of light in other portions of the visible spectrum. As a result, the amount of reflected external light from the phosphor layers can be largely reduced without interfering with light emission of each phosphor layer, and an image can be displayed with high contrast. In this case, phosphor particles of each color can be coated with a substance having the above property to form a filter layer.

In using a coating of a slurry of a pigmented phosphor, if a large amount of binder is used so that the pigment is not removed from the phosphor particles, the dispersibility of the phosphor particles is degraded, and pinholes are formed due to coagulation, or contamination occurs due to residual phosphor. For this reason, a binder is not often used, and therefore removal of the pigment cannot be prevented. When the pigment is removed and remains in the holes for another phosphor layer, light emission of another phosphor is interfered with to reduce the luminance and color purity.

In the method disclosed in the aforementioned Japanese Patent Disclosure No. 56-99945, the particle size of the silica particles used in the silica dispersion solution is about 40 nm. When such a silica dispersion solution (in a sol state) is coated on the entire surface of the faceplate and brought into contact with an HF vapor, silica particles which were primary particles in the sol state become two-dimensionally coagulated to form short-chain type huge particles and are scattered to adhere on the faceplate in a gel state, as shown in FIG. 1A. In this method, therefore, a pigment (less than 1.0 $\mu$), removed from the phosphor and having a particle size smaller than that of the phosphor particle (several $\mu$ to 50 $\mu$) by one order, enters into gaps between the two-dimensionally coagulated particles and remains in the holes for the phosphor layers.

SUMMARY OF THE INVENTION

It is an object of the present invention to provide a method of forming a color tube phosphor screen without a phosphor residual, especially a pigment residual.

According to the present invention, there is provided a method for forming a color tube phosphor screen comprising the steps of forming a light-absorbing matrix on a faceplate, coating a silica colloidal solution or an alumina colloidal solution containing a multivalent metal ion in the holes and washing the holes, and forming phosphor layers of three colors in the washed holes.

DETAILED DESCRIPTION OF THE PREFERRED EMBODIMENTS

Figure 1A:
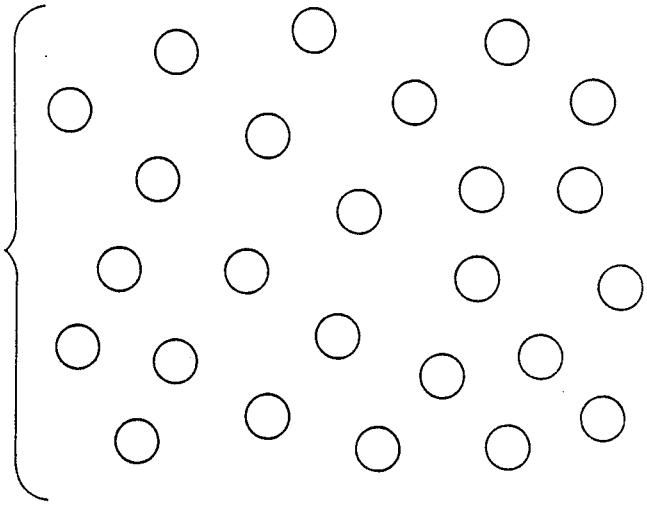
FIG. 1A (PRIOR ART)
FIGS. 1A and 1B are schematic views showing coagulated states of conventional silica particles.
Figure 1B:
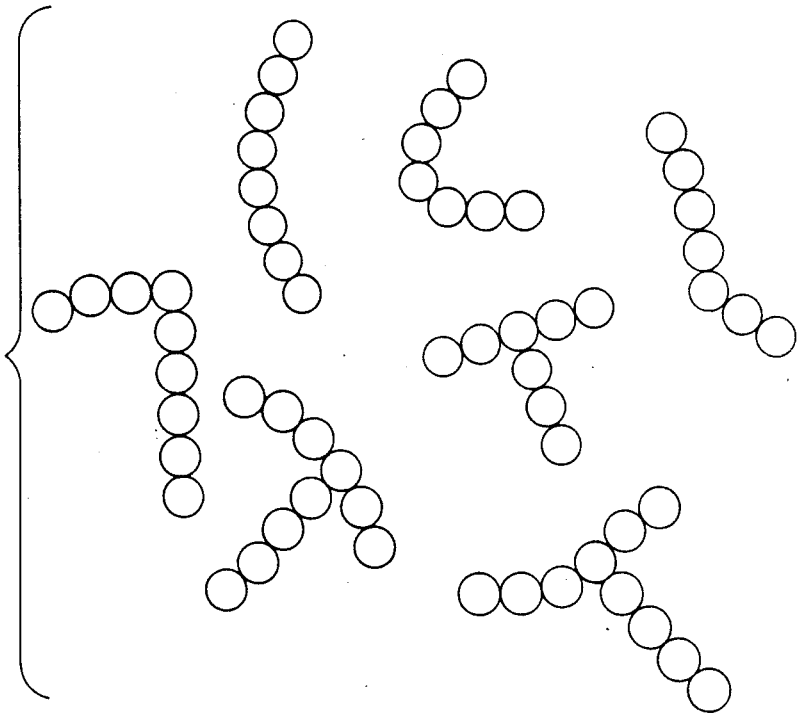
FIG. 1B (PRIOR ART)
Figure 2:
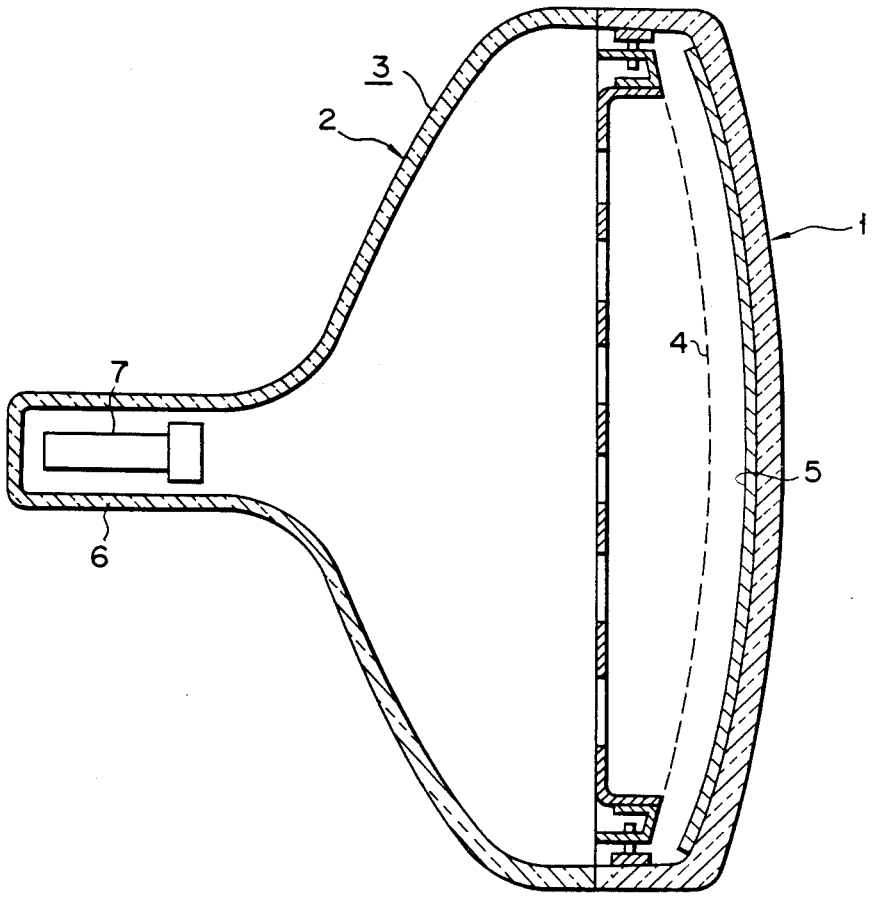
FIG. 2 is a sectional view showing a color tube.

As shown in FIG. 2, a shadow mask type color tube comprises envelope 3 including faceplate 1 and funnel 2 made of glass, and shadow mask 4 located in envelope 3. The inner surface of faceplate 1 opposing shadow mask 4 is phosphor screen 5. Dot- or stripe-like phosphor layers for emitting red, green and blue light are formed on phosphor screen 5. In-line type electron gun 7 for radiating electron beams which make the above phosphor layers of three colors emit light, is arranged in neck 6 of funnel 2.

In a step of forming a light-absorbing matrix according to the present invention, the holes are like dots or stripes. In addition, the light-absorbing matrix contains a light-absorbing substance such as black-colored graphite or cobalt oxide.

An example of various methods of forming a light-absorbing matrix will be described below. First, a photoresist solution mainly containing polyvinyl alcohol (PVA) as a resin component and a dichromate as a photosensitive agent is coated and dried on the inner surface of a washed faceplate, and exposed to ultraviolet rays through a shadow mask so as to be set like dots or stripes. The resultant material is developed to remove the photoresist at a portion not exposed to light. Thereafter, a light-absorbing substance is uniformly coated and dried on the entire surface of the faceplate. A hydrogen peroxide solution is coated on the entire surface of the light absorber so that the solution permeates into the light absorber and decomposes the set photoresist beneath it. The decomposed photoresist is removed together with a portion of the light absorber located immediately above the photoresist, thereby forming dot- or stripe-like holes at prospective phosphor layer formation portions.

Figure 3A:
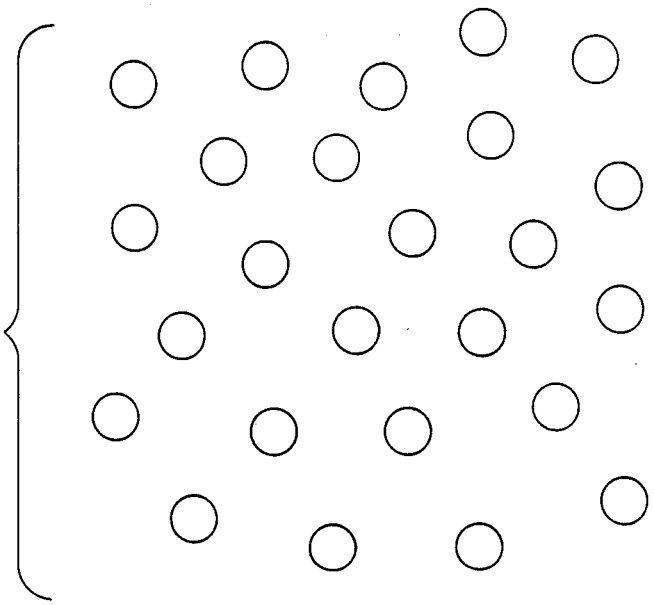
FIGS. 3A and 3B are schematic views showing coagulated states of silica particles according to the present invention.
Figure 3B:
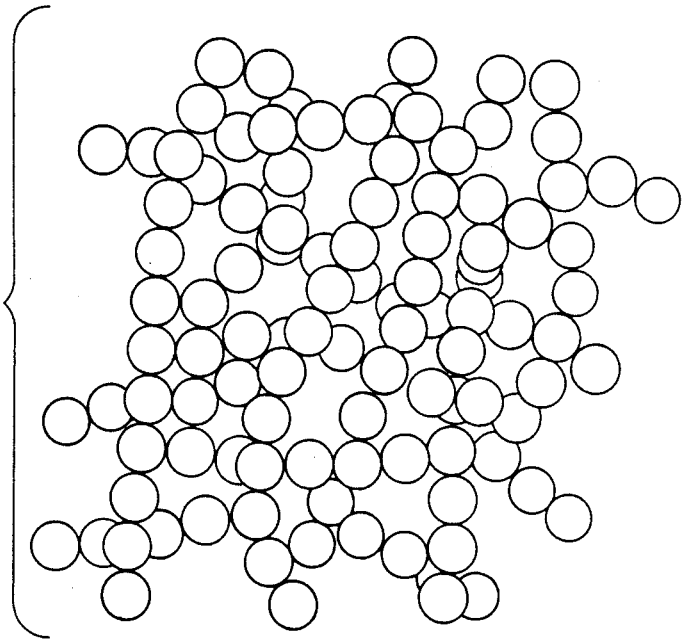

In a step of coating and washing a silica colloidal or alumina colloidal solution containing a multivalent metal ion in the holes, $Al^3$, $Ca^{2+}$, $Mg^{2+}$, $Zn^{2+}$, $Fe^{2+}$ or $Fe^{3+}$ is used as the multivalent metal ion having an ion valency of two or more. When the silica or alumina colloidal solution containing a multivalent metal ion is coated on the phosphor screen with the photoresist residual containing PVA as a main component, the overall electric charge balance of the silica or alumina solution is disturbed by the function of a multivalent metal ion. As a result, the silica or alumina solution forms a three-dimensional dense network structure film as shown in FIG. 3B, and bonds with the hydroxyl groups in the photoresist through hydrogen bond etc. Since this cubic structure is very dense, even a small size pigment alumina layer reaches and adhere on the active photoresist surface.

The concentration of the multivalent metal ion in the colloidal solution is preferably 5 to 100,000 ppm. If the concentration is less than 5 ppm, the above dense network structure cannot be obtained. If the concentration is more than 100,000 ppm, it is disadvantageous in terms of pot life of the solution.

The concentration of silica or alumina in the colloidal solution is preferably 0.01 to 10 wt %. If the concentration is less than 0.01 wt %, the above dense network structure cannot be obtained. If the concentration is more than 10 wt %, the solution cannot be uniformly coated to degrade the quality of the phosphor screen.

The particle size of the colloidal particles is preferably 25 nm. If the particle size exceeds 25 nm, gaps formed in the network structure are enlarged to degrade, with an effect of preventing adhesion of the pigment. The colloidal solution is coated by a flow method or a spray method.

Washing is often performed by pure water. In this case, however, the silica or alumina particles adhered on the photoresist are not removed.

The colors of the phosphor layers are blue, green and red. Examples of the blue, green and red phosphors are ZnS:Ag, Cl and ZnS:Ag, Al; ZnS:Cu, Al, ZnS:Cu, Au, Al, (ZnCd)S:Cu, Al and $Y_2O_2S$:Tb; and $Y_2O_2S$:Eu, $Y_2O_3$:Eu and $YVO_4$:Eu, respectively.

Examples of the pigment are cobalt blue and ultramarine for the blue phosphor, red iron oxide and molybdenum orange for the red phosphor substance, and chromium green and cobalt green for the green phosphor.

The present invention will be described in detail below by way of examples.

EXAMPLE 1

A photoresist layer comprising PVA and ammonium dichromate was formed on the inner surface of a faceplate, and a solution mixture of graphite and an acrylic resin was coated thereon. The resultant material was then exposed to light using a stripe-like mask, and the photoresist was removed by a hydrogen peroxide solution, thereby forming 1 to 2-$\mu$ thick light absorber having stripe-like holes. An aqueous silica dispersion containing 100 ppm of $Ca^{2+}$ ions (mixed as $Ca(NO_3)_2$) and 1.0 wt % of silica particles having a particle size of 10 to 20 nm was coated (precoated) on the entire surface of the faceplate at a rate of about 0.4 mg/cm$^2$ by a flow method. The entire surface of the faceplate was washed with pure water and then dried. When the surface of the holes was observed by an electron microscope, a silica layer having a dense network structure was formed. Each of the phosphor slurry prepared of blue phosphor ZnS:Ag, Cl (particle size=7.0 $\mu$) added with 5.0 wt % of ultramarine having a particle size of 0.5 $\mu$, green phosphor ZnS:Cu, Al (particle size=7.0 $\mu$), and red phosphor $Y_2O_2S$:Eu (particle size=7.0 $\mu$) added with 0.1 wt % of red iron oxide having a particle size of 0.3 $\mu$, respectively, was sequentially coated, exposed and developed to form phosphor layers of three colors of blue, green and red. Thereafter, a color tube was manufactured by a conventional method.

As Comparative Example 1, a color tube was manufactured following the same procedures as in Example 1 except that precoating was not performed. As Comparative Example 2, after a silica dispersion solution containing 0.3 wt % of silica particles having an average particle size of 40 nm was coated and exposed to an HF atmosphere as disclosed in Japanese Patent Disclosure (Kokai) No. 56-99945, a color tube having phosphor layers formed following the same procedures as in Example 1 was manufactured. As Comparative Example 3, a color tube was manufactured following the same procedures as in Comparative Example 2 except that the average particle size and content of the silica particles were set to be 10 to 20 nm and 1.0 wt %, respectively.

Table 1 shows a luminance and residual state of the pigment and the phosphor particle. The luminance is normalized assuming that the luminance obtained in Example 1 is 100.

TABLE 1

| | Residual of phosphor particle | Residual of pigment | Luminance |
|---|---|---|---|
| Example 1 | none | none | 100 |
| Comparative Example 1 | present | present | 95 |
| Comparative Example 2 | almost none | present | 96 |
| Comparative Example 3 | almost none | present | 97 |

EXAMPLE 2

A color tube was manufactured following the same procedures as in Example 1 except that alumina particles having an average particle size of 8 to 15 nm were used in place of the silica particles. The result was similar to that of Example 1. That is, neither pigment nor phosphor residual were found, and the luminance was 100.

EXAMPLES 3–7

Color tubes were manufactured following the same procedures as in Example 1 except that 50 ppm of $Al^{3+}$ (mixed as $Al(NO_3)_3$), $Mg^{2+}$ (mixed as $Mg(NO_3)_2$), $Zn^{2+}$ (mixed as $Zn(NO_3)_2$), $Fe^{2+}$ (mixed as $FeCl_2$), and $Fe^{3+}$ (mixed as $Fe(NO_3)_3$) were used in place of $Ca^{2+}$, respectively. The same result as in Example 1 was obtained in each example.

EXAMPLES 8 & 9

Color tubes were manufactured following the same procedures as in Example 1 except that the concentrations of silica particles were set to be 0.1 wt % and 10 wt %, respectively. The same result as in Example 1 was obtained.

EXAMPLE 10

A color tube was manufactured following the same procedures as in Example 1 except that the particle size of silica particles is set to be 4 to 6 nm. As a result, although neither pigment nor phosphor residual was found, the luminance was 99.

What is claimed is:

1. A method for forming a color tube phosphor screen, said method comprising the steps of:

forming a light-absorbing matrix having holes on a face plate with a residual photoresist;

coating a silica colloidal solution or an alumina colloidal solution having a concentration of 0.01 to 10 wt % and containing a multivalent metal ion in said holes, a particle size of the silica or alumina being 25 nm or less, the multivalent metal ion being at least one metal ion selected from the group consisting of $Al^{3+}$, $Ca^{2+}$, $Mg^{2+}$, $Zn^{2+}$, $Fe^{2+}$, and $Fe^{3+}$, and the concentration of the multivalent metal ion in the colloidal solution being 5 to 100,000 ppm;

washing said holes; and forming luminescent material layers of each of three different emission colors in each of said washed holes.

2. A method according to claim 1, wherein said light absorbing matrix contains one of graphite or cobalt oxide.

3. A method according to claim 1, wherein said residual photoresist forms one of a dot and stripe-like pattern.

* * * * *